US005778721A

United States Patent [19]

Klingel et al.

[11] Patent Number: 5,778,721

[45] Date of Patent: Jul. 14, 1998

[54] TOOLING MACHINE FOR RESHAPING WORKPIECES

[75] Inventors: Hans Klingel, Moglingen; Werner Erlenmaier, Gerlingen, both of Germany

[73] Assignee: Trumpf GmbH & Co., Ditzingen, Germany

[21] Appl. No.: 636,978

[22] Filed: Apr. 24, 1996

[30] Foreign Application Priority Data

Apr. 24, 1995 [DE] Germany ..... 295 06 877 U

[51] Int. Cl.[6] ..... B21D 22/04; B21D 28/24

[52] U.S. Cl. ..... 72/335; 72/401; 72/452.7; 72/452.9

[58] Field of Search ..... 72/401, 334, 335, 72/452.7, 452.8, 459.9

[56] References Cited

U.S. PATENT DOCUMENTS 5,005,396 4/1991 DeSmet ..... 72/309

*Primary Examiner*—David Jones

*Attorney, Agent, or Firm*—Pepe & Hazard LLP

[57] ABSTRACT

Machine tools are known, for forming workpieces, such as sheet metal, with tooling made of two tool halves arranged on opposite sides of the workpiece to be formed. One half of the tooling has at least one pressure element that can move against the workpiece and act on it and the other half of the tooling has at least one counter-pressure element that works with the pressure element to form the workpiece, and it is also movable against the workpiece. The movement of the pressure element against the workpiece activates the drive of the counter-pressure element in the direction opposite to the movement of the pressure element against the workpiece.

11 Claims, 2 Drawing Sheets

TOOLING MACHINE FOR RESHAPING WORKPIECES

BACKGROUND OF THE INVENTION

The invention concerns a machine tool, especially for reshaping workpieces, preferably sheets of metal, with tooling having two halves arranged on opposite sides of the workpiece to be machined, wherein one half of the tooling has a pressure element that can move against the workpiece and act on it and the other half of the tooling has one counter-pressure element that works with the pressure element to machine the workpiece.

Such machine tools are used to perform a wide variety of tooling operations. For example, generic presses for reshaping sheet metal are known in which one half of the tooling has a pressure element in the form of an extrusion die, which is hydraulically driven and presses the workpiece to be machined into a stationary matrix acting as a counter-pressure element in the second half of the tooling. In this way, the die penetrates into the resting matrix to a set depth. The relative movement between the die and the surface of the workpiece that is necessary to deform the workpiece on the matrix of the machine tool is based solely on the movement of the die. So it is a disadvantage that the die has to cover a relatively long path both when penetrating the matrix and also on its return stroke. So an individual machining cycle takes a long time.

The task of the invention is to develop a machine tool, especially for reshaping workpieces that can speed up such forming.

According to the invention, this task is solved by the fact that on the machine tool of the type mentioned previously, the counter-pressure element is movable and driven and can be moved against the workpiece, and by the fact that the pressure element moved against the workpiece activates the drive of the counter-pressure element in the direction opposite from the direction of movement of the pressure element over the workpiece and/or over a surface of the workpiece. The relative movement between the pressure element and the counter-pressure element necessary to form the workpiece is produced on such machine tools as a result of the simultaneous, opposing movements of the pressure and counter-pressure elements. Dividing the necessary total relative movement into two partial movements, parallel in time, can reduce the tooling time necessary for an individual machine cycle sharply. In the case of forms of embodiment of the machine tool in the present invention in which the drive for the counter-pressure element is coupled to a movement of the workpiece in the direction of the axis of movement of the pressure element and counter-pressure element, the amount of workpiece movement can be kept small by a corresponding configuration of the drive. This is particularly important if the workpiece is clamped while it is being formed on the machine and, as a result, can be ejected only slightly without adverse deformation in the direction of the axis of movement of the pressure element and the counter-pressure element. Corresponding structural measures on workpiece chucking, for example, pivot mounting, also give the workpiece mobility in the direction of the axis of movement mentioned; but on the machines of the present invention, the structural expenses associated with this are unnecessary for the reasons mentioned.

The movement of the counter-pressure element opposing the movement of he pressure element can be triggered and controlled in various ways. Thus, for example, the counter-pressure element can be moved by means of its own drive, which is turned on when the workpiece that moves with the pressure element or the workpiece area that is acted on by the pressure element that is moved, activates a corresponding switching device. A separate drive motor for the counter-pressure element, even without the inclusion of the workpiece or the workpiece surface, can also be set in motion. This last alternative is not, however, the object of this invention. One preferred embodiment of the machine tool of this invention provides that the counter-pressure element be movable by means of a deflecting gear activated by the pressure element moved over the workpiece and/or over the workpiece surface in the opposite direction from the movement of the pressure element. In this case, the movement of the pressure element and the opposing movement of the counter-pressure element can be carried out advantageously with a single drive motor.

Various forms or embodiments of the machine tool of the present invention use deflecting gears with various designs. Thus, one provides that the deflecting gear have at least one piston-cylinder unit acted on by force by the pressure element moved over the workpiece as a source for a pressure medium, which has a drive connection to the counter-pressure element. Alternately or added to this, the deflecting gear has at least one hydraulic or at least one pneumatic piston-cylinder unit acted on by force by the pressure element moved. Such tooling machines have the advantage of being able to have a variable arrangement of individual gear components connected to one another by pressure lines.

One form or embodiment of the machine tool of the invention is characterized by a structurally simple, sturdy, low-maintenance gear solution in which the deflecting gear is designed as a mechanical gear. Here, the mechanical gear can have at least one gear lever and/or at least one gear block. In one simple case, a rocker-type gear lever is used which can be acted on one side of its joint by means of the pressure element and on the other side of its joint, the counter-pressure element is mounted in a support.

Of course, the invention also provides for deflecting gears in which the gear parts mentioned above are combined with one another. Thus, for example, a piston-cylinder unit can be disposed in a drive connection with gear levers and/or gear wedges via pressure lines.

Another preferred form of embodiment of the machine tool of the invention is characterized by the fact that on the parts of the counter-pressure element of the tooling, there is at least one longitudinal slide that can move in the same direction as the pressure element moved against the workpiece, which on its end spaced from the workpiece is tapered in a wedge shape, forming at least one wedge surface, and is supported with the wedge surface on a corresponding opposing wedge surface of a transverse slide that can move crosswise to the longitudinal slide; and the end of the transverse slide spaced from the longitudinal slide is also tapered into a wedge shape, forming a wedge surface, and is supported with this wedge surface on a corresponding opposing wedge surface provided on it or connected to the counter-pressure element. On such machines, the components of the structurally simply designed deflecting gear are in planar contact with one another. Accordingly, great drive forces can be transmitted over the deflecting gear. The transmission ratios for the gear can be set simply by choosing the tool-orthogonal wedge angle. In this way, the invention offers a way of replacing the cross slide and wedge surfaces with a movable ball supported on one hand on the longitudinal slide and on the other on the counter-pressure element or a component connected to it that can move crosswise to the direction of movement of the longitudinal slide or counter-pressure element or a movable roller mounted accordingly. The use of a ball has the advantage of point contact; the use of a roller has the advantage of line contact with the adjacent gear elements. The friction losses that occur during movement or transmission of force to the contact points of the ball or roller with the longitudinal slide and the counter-pressure element or the components connected to it are small.

Precise guidance of the counter-pressure element moved as provide in another advantageous embodiment of the invention serves to place the counter-pressure element on a sliding piece of the tooling half in question that can be guided and moved.

For corresponding reasons, the case of another preferred form of embodiment of the machine tool of the present invention provides that the counter-pressure element have a base plate that extends basically perpendicularly to its direction of movement with window-type recesses and is used with the base plate in a top-shaped recess of the tooling half in question; in each of the window-type recesses, there is a transverse slide supported with one of its wedge surfaces on an opposing wedge surface of the base plate that moves in the direction of the plane of the base plate. The front surface of the base plate, which runs parallel to the direction of movement of the counter-pressure element, works with the adjacent wall of the pot-like holder and provides a defined position for the counter-pressure element transversely of its direction of movement and provides precise guidance of the counter-pressure element moved in the direction of movement. By using several transverse slides to transmit the forces to the base plate or to the counter-pressure element placed on it, and arranging the window-like recesses accordingly, force can be introduced into the base plate at points distributed evenly around its periphery. Tilting movements of the base plate and thus the counter-pressure element that might otherwise occur or another type of pressure acting on the base plate in the direction of the wall of the pot-shaped holder are thereby avoided.

On the machines of the present invention, care must be taken that the counter-pressure element moved in the direction of the pressure element and working with it to form materials goes back into its starting position after the end of the machine cycle. In the case of counter-pressure elements moved vertically, this return movement can take place under the effect of the inherent mass of the counter-pressure element. However, the invention conveniently provides that the counter-pressure element be movable against spring force in the direction of the workpiece. The spring force works as a return force and makes sure that the counter-pressure element is actively moved back into its starting position after the end of each machine cycle.

In the case of forms of embodiment of the machine of the invention that have a counter-pressure element with a base plate, the base plate is supported in the direction of the workpiece on a springy elastic rubber bumper. The rubber bumper is a component that can also work after a large number of load alterations. If the rubber bumper is designed like a ring and, for example, set on the base plate concentric with the counter-pressure element, then there is even spring support over its periphery. Accordingly, the return force exerted on the base plate by the rubber bumper and the counter-pressure element on it is uniform in the transverse direction of the plane of the base plate. Tilting movements and/or tipping of the base plate pushed back into the starting position against the inside wall of the potshaped holder are avoided.

To make it simple to refit the machine tool, another advantageous embodiment of the invention provides that the counter-pressure element be attached to the sliding piece, if necessary to the base plate, so that it can be detached. If necessary, the counter-pressure element can be changed with no problem while the other components of the deflecting gear and the other parts of the tooling halves in question can also be used to perform the workpiece forming to be done after the machine is refitted.

The invention will be described in greater detail below using schematic drawings and examples.

DETAILED DESCRIPTION OF THE PREFERRED EMBODIMENT

Figure 1:
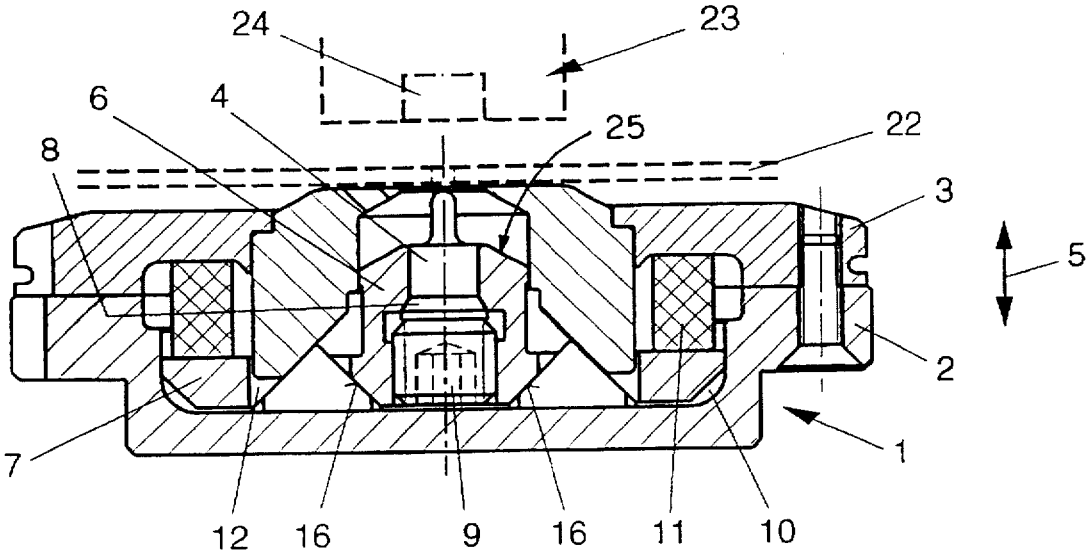
FIG. 1 shows a cross section of forming tooling embodying the present invention along the section line 1—1 in FIG. 3 in the starting position for producing eyelets in sheet metal.
Figure 2:
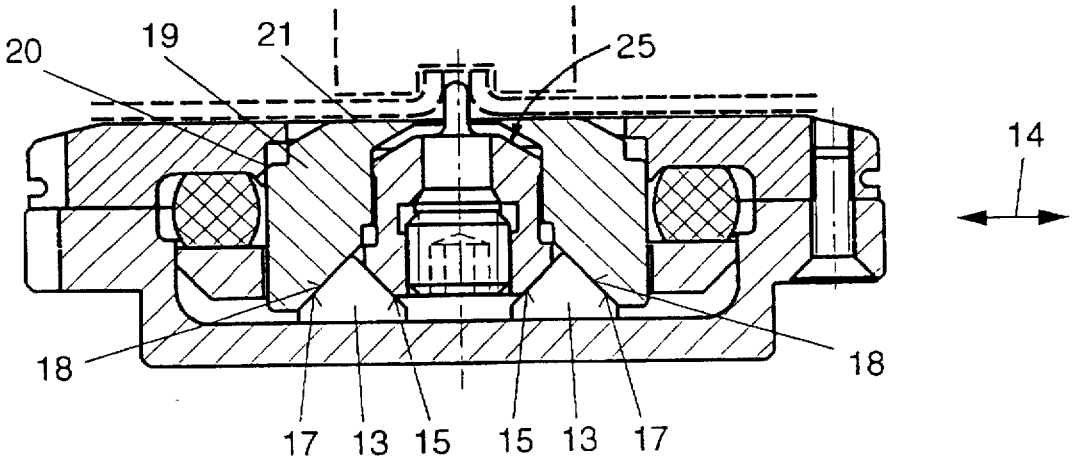
FIG. 2 shows the forming tooling in FIG. 1 in the position of forming the workpiece.
Figure 3:
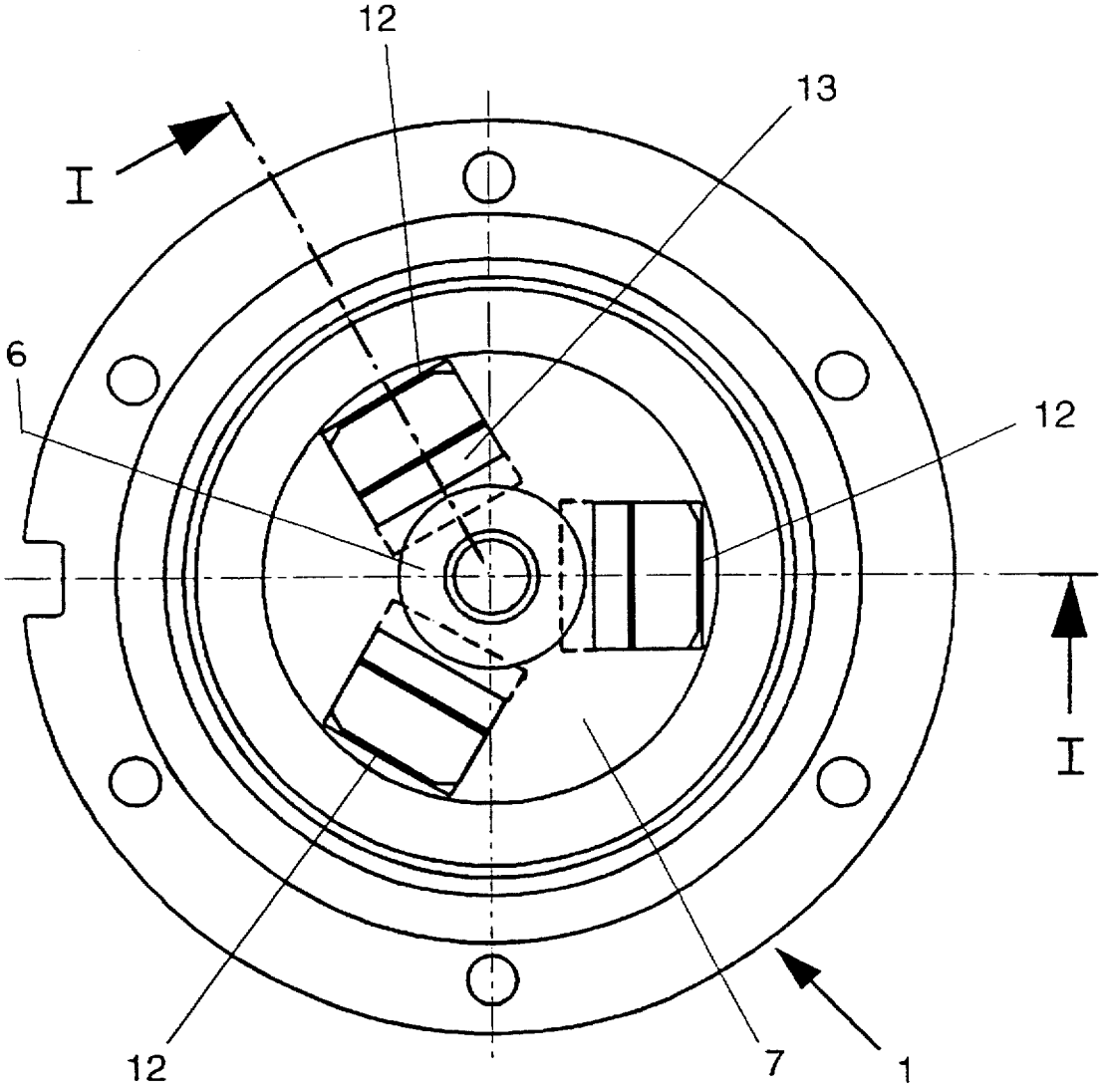
FIG. 3 shows a top view of the base part and other working parts in the bottom half of the tooling in FIGS. 1 and 2.

As can be seen in FIGS. 1 to 3, one-half 1 of the tooling embodying the present invention for forming workpieces utilizing a punch press or the like shown includes a base part 2 and a cover part 3 screwed onto it. Inside the half 1 of the tool that includes the base part 2 and the cover part 3, a counter-pressure element in the form of a punch 4 can move and be moved in the direction of the double headed arrow 5. For this purpose, the punch 4 is fixed in a cavity in the upstanding portion 6 of a punch holder generally designated by the numeral 25 and having a base flange 7. The punch 4 is positioned in the axial direction, on one hand, by the top surface of its conical collar 8 on a corresponding opposing surface of the cavity in the upstanding supporting portion 6. In the opposite axial direction, the punch 4 is secured by a threaded part or set screw 9, which can be provided with an outer thread cooperating with an inside thread in the aperture in the punch holder 25. The bottom part 2 of the tooling half 1 has a cylinder cavity 10 inside for the base flange 7 with the punch 4 on it. A annular spring element or rubber bumper 11 is inserted concentrically with the punch 4 and under slight compression in the direction of the double headed arrow 5 between the base flange 7 and the upper or cover part 3 of the tooling half 1.

Three apertures or passages 12 are provided in the base flange 7, staggered 120° C. to one another in the peripheral direction. Slidably seated in the cavity 10 are sliding wedges 13 that can move radially in the window-like apertures 12 in the direction of the double headed arrow 14. The base surfaces of the sliding wedges 13 are supported on the bottom of the cavity 10 in the base part 2. The wedge surfaces 15 of the wedges 13 facing the punch 4 are adjacent to corresponding opposing wedge surfaces 16 on the base flange 7. On the side facing away from the punch 4 the wedges 13 have an oppositely disposed wedge surface 17, which is in contact with a cooperating wedge surface 18 in the longitudinal slide or thrust member 19. The longitudinal slide 19 has a cylindrical body with three projections on the end facing the base of the cavity 10. These projections project into the apertures 12 in the base flange 7 and are beveled on the sides opposite the wedge 13 forming cooperating wedge surfaces 18. The cylindrically configured longitudinal slide or thrust member 19 extends into a guide surface 20 on the top part 3 which is concentric with it and is movable in the direction of the double headed arrow 5. On the side disposed away from the base of the cavity 10, the longitudinal slide 19 has a supporting surface 21 for a workpiece 22 shown in broken line in FIGS. 1 and 2 in the form of a pre-perforated sheet of metal 22. In FIGS. 1 and 2, the second tooling half 23 is also shown in broken line in the form of a die used as a pressure element and it has a cylindrical recess 24 for the punch 4.

To produce eyelets on the pre-perforated sheet of metal 22, it is first put into the position shown in FIG. 1, in which the is disposed coaxially with the punch 4. Then the tooling half 23 in FIG. 1 is pushed down. The die 23 first bears on the surface of the sheet metal 22 facing it. As the movement continues, the tooling half 23 pushes the sheet metal 22 and the longitudinal slide or thrust member 19 under it downwardly until the sheet metal 22 comes to lie on the area surrounding the longitudinal slide 19 on top of the upper surface of the top part 3. During the movement described, the longitudinal slide 19 and its wedge surfaces 18 slide along the adjacent opposing wedge surfaces 17 of the wedges 13. Since the longitudinal slide 19 moves over the guide surface 20 of the cover part 3 as well as the bordering surfaces of the apertures 12 about the projections on its lower end, its movement makes the wedges 13 move radially upwardly in the direction of the punch 4. The wedge surfaces 15 of the wedge 13 slide on the opposing wedge surfaces 16 of the base flange 7 facing it and push the punch holder 25, along with punch 4 seated in it, upwardly from the base of the cavity 10. As a result, the punch 4 moves opposite to the direction of movement of the upper tooling half containing the die 23 and the punch 4 and the die in the upper tooling half 23 work together to deform the sheet metal 22 in the manner shown in FIG. 2. The relative movement between the punch 4 and the edge of the cylindrical recess 24 in the die in the upper tooling half 23 necessary to reshape the sheet metal 22 is produced accordingly as a result of the partial movements made by the die in the upper tooling half 23 and the punch 4 in opposing directions. The sheet metal 22 itself is moved over a short path in the direction of the axis of movement of the die in the upper tooling half 23 and the punch 4. The length of the path of the sheet metal 22 is limited to the guided length shown in FIG. 1 of the longitudinal slide or thrust member 19 compared to the area surrounding it on top of the cover part 3.

As can be inferred especially from FIG. 2, the stroke movement of the base flange 7 is compressing the spring or rubber bumper 11. Now, as soon as the die in the upper tooling half 23 is lifted off the surface of the sheet metal 22 after the end of the machine cycle, the base flange 7 is pushed back into the starting position shown in FIG. 1 by the effect of the return force exerted by the spring or rubber bumper 11. Along with this, the wedges 13 are moved radially outwardly and, as a result, the longitudinal slide or thrust member 19 is raised into the starting position shown in FIG. 1. The sheet metal 22 in the area of the eyelet now produced is pushed off the punch 4 by the return movement of the longitudinal slide 19.

The die in the upper tooling half 23 shown in FIGS. 1 and 2, and the punch 4 and the other parts of the tooling half 1 in question can be used in the tool receptacles on a punching machine. For example, the die of the upper tooling half 23 can be attached to the ram of the punch and the lower tooling half 1 with the punch 4 in the lower toolholder otherwise intended to take a punching tool. In this way, a punch can be refitted quickly and easily into a machine tool for forming workpieces. The sheet metal to be formed can be guided quickly and precisely to the respective forming position by means of the workpiece guide mechanism provided on the punch press and can be pushed into the next tooling position, so that high machine speeds can be achieved. To adjust to changing sheet metal thickness and/or changing diameters of the sheet metal perforation, the punch 4 can be changed at low expense. Since the die in the upper tooling half 23 with its round recess 24 is generally coordinated with the size of the punch 4 used, the die must be changed when the punch 4 is changed, as a rule.

We claim:

1. Tooling for use in a machine tool having a pressure element movable against a support surface for forming workpieces and disposed therebetween, said tooling comprising:

(a) a first tooling half adapted for mounting on the pressure element for movement therewith against a workpiece disposed between the pressure element and support surface and providing a first tool element;

(b) a second tooling half adapted for mounting in the support surface and providing a second tool element cooperating with said first tool element to shape a workpiece, said second tooling half comprising;

(i) a housing providing a cavity;

(ii) a thrust member slidably seated in said cavity and projecting outwardly of said housing, said thrust member being movable axially inwardly of said housing when acted upon by movement of said first tooling held thereagainst, said thrust member slidably seating said second tool element for axial movement therewithin; and (iii) moving means for slidably moving each second tool element axially oppositely of the movement of said thrust member and outwardly of said thrust member to cooperate with said first tool element, said thrust member having at least one inclined surface bearing upon a cooperating inclined surface of a wedge member slidably seated in said housing and movable against an inclined surface on said second tool member to move it axially within said thrust member and thereby provide said moving means.

2. Tooling in accordance with claim 1 wherein said first tool element is a die and said second tool element is a punch.

3. Tooling in accordance with claim 1 wherein said moving means is a gear actuated by axial movement of said thrust member inwardly of said housing.

4. Tooling in accordance with claim 1 wherein said thrust member has a multiplicity of inclined surfaces spaced thereabout and cooperating with a multiplicity of wedge members slidable radially in said housing.

5. Tooling in accordance with claim 4 wherein said second tool element is seated in a tool holder having a flange with a multiplicity of radially oriented slots extending axially therethrough in which said wedges are slidably seated and into which extend portions of said thrust member having said inclined surfaces.

6. Tooling in accordance with claim 1 wherein said second tooling half includes means for returning said thrust member and tool element to their initial positions upon movement of said first tooling half away from said second tooling half.

7. Tooling in accordance with claim 6 wherein said returning means is a resiliently compressible member.

8. Tooling in accordance with claim 7 wherein said resiliently compressible member is an annular elastomeric member.

9. Tooling for use in a machine tool having a pressure element movable against a support surface for forming workpieces disposed therebetween, said tooling comprising:

(a) a first tooling half adapted for mounting on the pressure element for movement therewith against a workpiece disposed between the pressure element and support surface and providing a first tool element;

(b) a second tooling half adapted for mounting in the support surface and providing a second tool element cooperating with said first tool element to shape a workpiece, said second tooling half comprising:

(i) a housing providing a cavity;

(ii) a thrust member slidably seated in said cavity and projecting outwardly of said housing, said thrust member being movable axially inwardly of said housing when acted upon by movement of said first tooling half thereagainst, said thrust member slidably seating said second tool element for axial movement therewithin;

(iii) moving means for slidably moving such second tool element axially oppositely of the movement of said thrust member and outwardly of said thrust member to cooperate with said first tool element, said thrust member having a multiplicity of inclined surfaces spaced thereabout and cooperating with a multiplicity of wedge members slidable radially in said housing, and said thrust member having at least one inclined surface bearing upon a cooperating inclined surface of a wedge member slidably seated in said housing and movable against an inclined surface on said second tool member to move it axially within said thrust member and thereby provide said moving means;

(iv) means for returning said thrust member and tool element to their initial positions upon movement of said first tooling half away from said tooling half.

10. Tooling in accordance with claim 9 wherein said second tool element is seated in a tool holder having a flange with a multiplicity of radially oriented slots extending axially therethrough in which said wedges are slidably seated and into which extend portions of said thrust member having said inclined surfaces.

11. Tooling in accordance with claim 10 wherein said returning means is a resiliently compressible member.

* * * * *